US007670397B2

(12) United States Patent
Bauer

(10) Patent No.: US 7,670,397 B2
(45) Date of Patent: Mar. 2, 2010

(54) FILTER-FAN UNIT

(75) Inventor: Helmut Bauer, Ludwigsburg (DE)

(73) Assignee: M+W Zander Products GmbH, Stuttgart (DE)

( * ) Notice: Subject to any disclaimer, the term of this patent is extended or adjusted under 35 U.S.C. 154(b) by 352 days.

(21) Appl. No.: 11/612,498

(22) Filed: Dec. 19, 2006

(65) Prior Publication Data

US 2007/0144119 A1 Jun. 28, 2007

(30) Foreign Application Priority Data

Dec. 19, 2005 (DE) ..... 10 2005 062 523

(51) Int. Cl.
*B01D 46/00* (2006.01)

(52) U.S. Cl. ..... 55/356; 55/422; 55/471; 55/496

(58) Field of Classification Search ..... 55/385.2, 55/471, 356, DIG. 5, 467, 493, 422, 496; 454/187; 52/66
See application file for complete search history.

(56) References Cited

U.S. PATENT DOCUMENTS 2,594,688 A * 4/1952 Shapiro ..... 55/467
2,992,701 A * 7/1961 White ..... 55/309
3,520,115 A * 7/1970 Bowen ..... 55/422
3,570,220 A * 3/1971 Felter ..... 55/385.7
3,644,011 A * 2/1972 MacDonald ..... 312/258
3,796,342 A * 3/1974 Sanders et al. ..... 220/6
3,861,894 A * 1/1975 Marsh ..... 96/121
3,935,803 A * 2/1976 Bush ..... 454/189
4,166,343 A * 9/1979 O'Brian et al. ..... 52/66
4,560,395 A * 12/1985 Davis ..... 96/381
4,577,772 A * 3/1986 Bigliardi ..... 220/1.5
4,630,746 A * 12/1986 Fortenberry ..... 220/6
4,646,928 A * 3/1987 Ono et al. ..... 220/6
4,684,034 A * 8/1987 Ono et al. ..... 220/6
4,749,390 A * 6/1988 Burnett et al. ..... 96/57
4,790,863 A * 12/1988 Nobiraki et al. ..... 96/384
4,889,252 A * 12/1989 Rockom et al. ..... 229/103.11
4,894,071 A * 1/1990 Klein ..... 95/273
4,900,342 A * 2/1990 Spengler ..... 96/381
4,961,766 A * 10/1990 Hogan ..... 55/385.2
5,038,953 A * 8/1991 Radar ..... 220/6
5,053,065 A * 10/1991 Garay et al. ..... 55/470
5,141,540 A * 8/1992 Helmus ..... 55/385.2
5,162,132 A * 11/1992 Diaz ..... 427/470
5,167,681 A * 12/1992 O'Keefe et al. ..... 55/385.2
5,266,090 A * 11/1993 Burnett ..... 55/333
5,297,990 A * 3/1994 Renz et al. ..... 454/187
5,348,563 A * 9/1994 Davis ..... 55/385.2
5,792,226 A * 8/1998 Lee et al. ..... 55/385.2
5,807,415 A * 9/1998 Leo ..... 55/385.3
5,876,279 A * 3/1999 Renz et al. ..... 454/187
6,006,918 A * 12/1999 Hart ..... 206/600

(Continued)

*Primary Examiner*—Duane Smith
*Assistant Examiner*—Sonji Turner
(74) *Attorney, Agent, or Firm*—Gudrun E. Huckett

(57) ABSTRACT

A filter-fan unit has a housing, at least one fan arranged in the housing, and at least one filter connected to the housing. The housing is transferable from a transport/storage position into a position of use, wherein the transport/storage position is significantly smaller than the position of use. The housing is foldable from the transport/storage position into the position of use. The housing has a housing frame and one or more sidewalls connected with one side to the housing frame.

36 Claims, 20 Drawing Sheets

U.S. PATENT DOCUMENTS 6,019,808 A * 2/2000 Ishikawa et al. ..... 55/320
6,027,406 A * 2/2000 Yazici ..... 454/338
6,099,607 A * 8/2000 Haslebacher ..... 55/356
6,174,342 B1 * 1/2001 Jeanseau ..... 55/385.2
6,200,215 B1 * 3/2001 Larsson et al. ..... 454/187
6,220,473 B1 * 4/2001 Lehman et al. ..... 220/592.27
6,264,727 B1 * 7/2001 Elmore ..... 95/143
6,368,393 B1 * 4/2002 Hironaka ..... 96/111
6,383,241 B1 * 5/2002 Janus et al. ..... 55/385.2
6,454,834 B1 * 9/2002 Livingstone et al. ..... 95/11
6,497,739 B2 * 12/2002 McGill ..... 55/385.2
6,569,008 B1 * 5/2003 Chang ..... 454/67
6,648,159 B2 * 11/2003 Prutkin et al. ..... 220/4.28
6,802,311 B1 * 10/2004 Yeung ..... 126/299 R
6,802,361 B2 * 10/2004 Hatanaka ..... 165/53
6,902,603 B2 * 6/2005 Wiser et al. ..... 96/16
7,083,061 B2 * 8/2006 Spindel et al. ..... 220/6
7,243,674 B2 * 7/2007 Devine ..... 137/375
2001/0049927 A1 * 12/2001 Toepel ..... 55/385.2
2005/0132677 A1 * 6/2005 Bauer et al. ..... 55/385.2
2008/0034718 A1 * 2/2008 Schuld et al. ..... 55/495
2008/0045135 A1 * 2/2008 Pfannenberg ..... 454/184

* cited by examiner

FILTER-FAN UNIT

BACKGROUND OF THE INVENTION

The invention relates to a filter-fan unit comprising a housing in which at least one fan is arranged and which comprises at least one filter.

Filter-fan units have a housing made from sheet metal or plastic material in which the fan, optionally a soundproofing device and/or at least one suspended particle filter are installed fixedly. The filter-fan units are rigid and are transported in their assembled state and size, mounted on a filter or mounted, including the filter, in a ceiling grid. For mounting a unit that has a square contour from the cleanroom side, the ceiling has profiled section with insertion strips because the unit when it has a certain height can no longer be pushed diagonally through the opening of the ceiling grid. Storing and transporting such filter-fan units is complex and expensive because of the large size. In particular, the space required for storage and transport is significant.

SUMMARY OF THE INVENTION

It is an object of the present invention to configure a filter-fan unit of the aforementioned kind such that it can be easily stored and/or transported and/or mounted.

In accordance with the present invention, this is achieved in that the housing can be transferred from a transport/storage position having a small size into a position of used having a large size.

In the filter-fan unit according to the invention, the housing can have a small size during transport and/or when stored. At the site where the filter-fan unit is to be mounted, the housing is transferred from the transport/storage position into a position of use. In the position of use the housing has its final predetermined size. The housing of the filter-fan unit is thus no rigid component but has a foldable or collapsible construction that can be comprised of different materials, for example, sheet metal, plastic material, fabric and the like. Since the housing can be transferred into a small size for transport and/storage, the filter-fan unit requires only a small space. Once delivered to the site where it is to be installed, the housing is transferred into the large final size. Accordingly, the housing can be unfolded, for example, once it is located in the cleanroom or the supply air plenum, the open edges can be connected and the filter-fan unit formed in this way can be placed onto the filter. Likewise, mounting of the fan can also be realized in the cleanroom or the supply air plenum.

The filter-fan unit can have the soundproofing elements that obtain their full size and efficiency only upon unfolding of the housing. Such sound-proofing elements can be, for example, open-pore foam material, micro-porous films and the like.

In a first embodiment, the filter, the housing, and the fan each are an independent component whose housing can be, for example, folded or collapsed. However, it is also possible that the filter and the housing together form a module and that the fan is a separate component. It is also possible that the housing and the fan together form a module and that the filter is a separate component. Finally, the filter, the housing, and the fan can formed a module.

Since the housing can be folded or collapsed to a small size (to a size or height much smaller or significantly smaller than the housing in its position of use—theoretically it can be reduced to a height that corresponds to the thickness of the sidewalls and the housing frame or the lid), a very small transport/storage size results. When filter and housing form a module, during transport and/or storage the size of the module is not larger than that of the filter or only insignificantly larger. Advantageously, the housing can be folded to be flat. The housing can be combined with filters of different manufacturers.

In contrast to known filter-fan units, an inventive filter-fan unit having a square contour can be mounted from the cleanroom side without requiring insertion strips. This is so because the housing when in the flat, folded or collapsed state can be pushed diagonally through the opening in the ceiling grid.

Each component of the filter-fan unit, i.e., the filter, the housing, and the fan can be delivered separately to the construction site. Intermediate transports, for example, transporting the fan to the manufacturer of the housing, are not required. Also, the required space during installation in the cleanroom at the customer site is significantly reduced because of the configuration in accordance with the invention. Also, the installation, in particular, in cleanrooms with high ceilings is significantly simplified because of the reduced size of the collapsed housing.

The housing can be produced from any suitable material, for example, sheet metal, plastic material or fabric in particular flame resistant canvas material.

When the housing walls are supported in a pivotable way, it is possible to employ weakened portions in the material as predetermined bending locations, hinges or strap hinges as a pivotable connection. When the housing is made from fabric, it is possible to connect the tailored sections of the fabric by means of a zipper or a hook-and-loop fastener.

The connection of the fan or the fan unit and the housing can be realized in any suitable way, for example, by placing the fan unit onto an angled portion of the housing wall, by gluing with a double-sided adhesive tape or, for example, by connecting with snap-fit closures.

DESCRIPTION OF THE PREFERRED EMBODIMENTS

Figure 3:
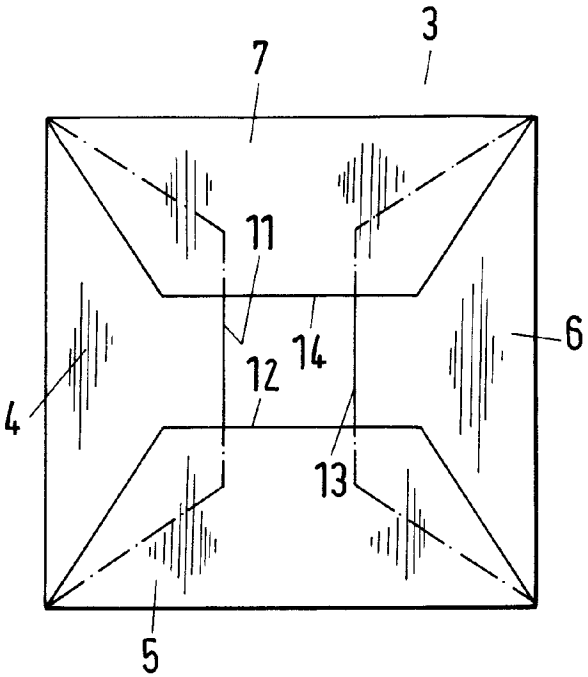
FIG. 3 is a plan view onto the folded housing according to FIG. 1.
Figure 4:
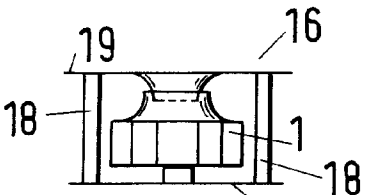
FIG. 4 is a schematic illustration of a fan insert of the filter-fan unit according to the invention.
Figure 1:
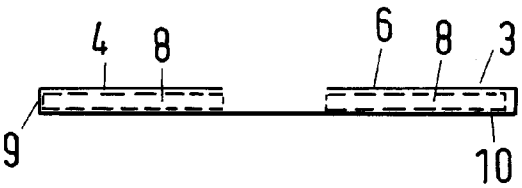
FIG. 1 is a schematic side view illustration of a folded housing of a filter-fan unit according to the invention.
Figure 2:
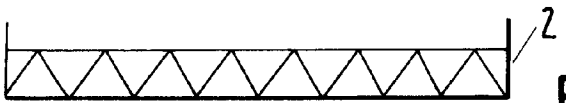
FIG. 2 is a schematic illustration of a suspended particle filter of the filter-fan unit according to the invention.

Filter-fan units are used advantageously in clean rooms in the ceiling area. The filter-fan units are comprised essentially of three components, i.e., at least one fan 1, at least one suspended particle filter 2, and a housing 3. The suspended particle filter 2 is preferably a HEPA filter (High Efficiency Particulate Air) but can also be any other suitable filter in accordance with the specific requirements of the application. The filter-fan units according to FIGS. 1 through 9 are characterized in that the housing 3 can be folded (FIGS. 1 and 3). The housing 3 therefore requires little space during transport. The housing 3 is unfolded once at the site where it is to be installed. Thereafter, the fan 1 and the suspended particle filter 2 are mounted on the unfolded housing 3. Since the housing 3 is foldable or collapsible, it requires only very little space during transport.

In the embodiment according to FIGS. 1 through 9, the housing 3 has four sidewalls 4 to 7 that are positioned at a right angle to one another. The housing sidewalls 4, 5, 6, 7 each are trapezoidal in shape and have the same size. As shown in FIG. 1, the sidewalls 4, 5, 6, 7 are provided at their inner side or face with a soundproofing layer 8 that is advantageously comprised of an open-pore foam material.

The sidewalls 4 through 7 are connected to a narrow circumferential rim 9 having a height that corresponds approximately to the thickness of the soundproofing layer 8. The circumferential rim 9 projects at a right angle from the bottom housing frame 10 that has a square contour, for example.

Figure 7:
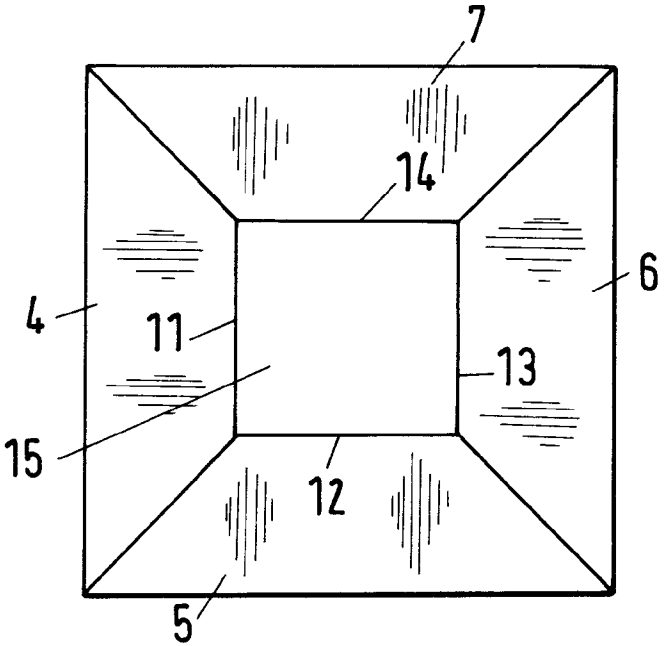
FIG. 7 is a plan view of the unfolded housing according to FIG. 5.
Figure 5:
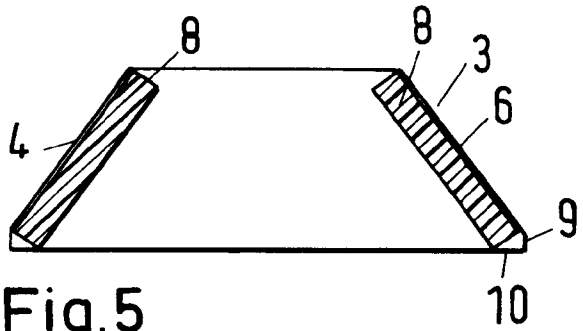
FIG. 5 shows the housing according to FIG. 1 in the unfolded state.
Figure 6:
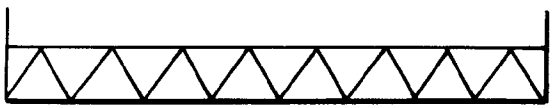
FIG. 6 shows the suspended particle filter according to FIG. 2.
Figure 9:
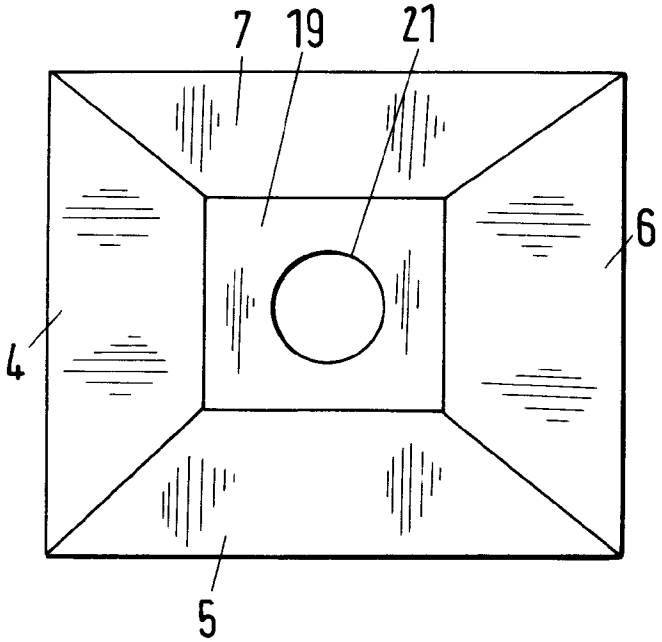
FIG. 9 shows the filter-fan unit according to FIG. 8 in a plan view.
Figure 8:
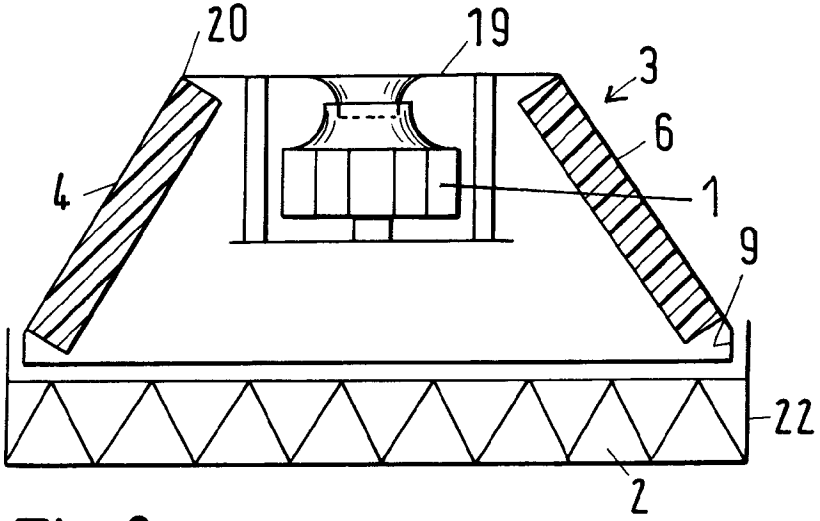
FIG. 8 shows a side view of the mounted filter-fan un it with unfolded housing, the suspended particle filter, and the inserted fan insert.
Figure 11:
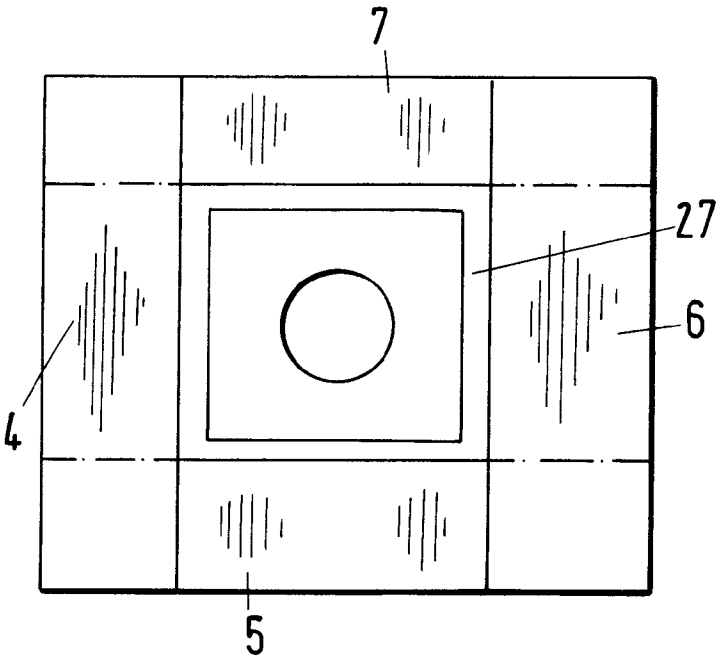
FIG. 11 is a plan view of a second embodiment of a filter-fan unit according to the invention showing the folded housing in which the filter insert is mounted.
Figure 12:
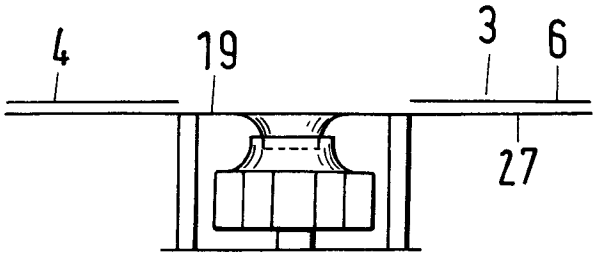
FIG. 12 is a side view of the folded housing with fan insert according to FIG. 11.
Figure 10:
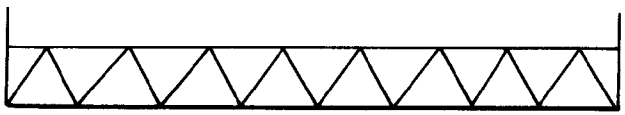
FIG. 10 is a side view showing schematically a second embodiment of a suspended particle filter of the filter-fan unit according to the invention.
Figure 14:
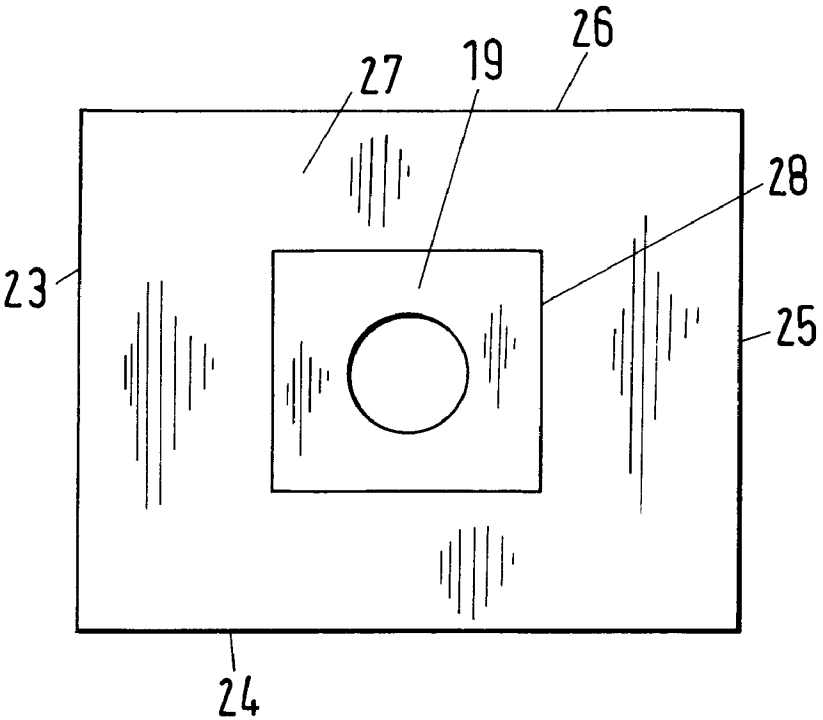
FIG. 14 is a plan view onto the unfolded housing according to FIG. 13.

As shown in FIG. 3, the sidewalls 4 through 7 taper in a direction away from the rim 9 so that in the folded state the free edges 11 through 14 are spaced from one another. In order to complete the filter-fan unit, first the housing 3 is unfolded such that the sidewalls 4 to 7 are positioned with their slanted lateral edges against one another (FIG. 7). The adjoining lateral edges of the sidewalls 4 to 7 are connected in a suitable way fixedly and tightly to one another. The sidewalls 4 to 7 are positioned at an acute angle relative to the rim 9 of the housing 3 and converge starting at the rim 9. Because the soundproofing layers 8 are attached to the inner side of the sidewalls 4 through 7, the soundproofing layers 8 are moved into their final mounted position when folding upwardly the sidewalls 4 to 7. The housing 3 in the unfolded state has the shape of a square pyramid. The free edges 11 through 14 of the sidewalls 4 through 7 delimit in the illustrated embodiment a square mounting opening 15 into which the fan 1 can be inserted. The fan 1 is part of a fan insert 16 that has a baseplate 17 on which the fan 1 is mounted in a way known in the art. The baseplate 17 is connected by means of vertical supports 18 to a mounting plate 19 that is connected to the free edges 11 to 14 of the sidewalls 4 to 7 with its edge 20, as shown in FIG. 8. The mounting plate 19 has a central opening 21 through which the fan 1 sucks in air. The mounting plate 19 is advantageously connected with its edge 20 air-tightly to the housing 3 so that the clean air which is sucked in by the fan 1 can flow out only through the filter 2.

At the bottom side of the unfolded housing 3 the suspended particle filter 2 is mounted. The filter 2 has a circumferential filter frame 22 that projects upwardly past the suspended particle filter 2 and is connected with this projecting part to the rim 9 of the housing 3.

The collapsible housing 3 can be comprised of sheet metal or a suitable plastic material. The plastic material can be polyamide, polyethylene, polypropylene, or polyvinyl chloride as a thermoplastic material. It is also possible to employ a thermosetting material, for example, polyester or polyurethane. Finally, it is also possible to produce the housing, for example, from epoxy resin, polyester resin, Styrofoam® (polystyrene), Macrolon® (polycarbonate), acrylic glass, and the like. The housing 3 has in any case a sufficient stability and strength in order to support the fan insert 16 and the suspended particle filter 2.

The pivot connection between the sidewalls 4 to 7 and the rim 9 can be designed in different ways. Examples of different configurations will be explained in more detail in connection with FIGS. 39 to 42.

FIGS. 10 through 16 show a fan unit in which the foldable housing 3 is attached already to the mounting plate 19 of the fan insert 16. After folding out the sidewalls 4 to 7 of the housing 3, it is no longer necessary to connect the fan insert 16 in a separate working step to the housing 3. The sidewalls 4 to 7, in contrast to the preceding embodiment, are rectangular in shape (FIG. 11) and extend between the oppositely positioned parallel extending circumferential edges 23, 24, 25, 26 of a housing lid 27 (compare FIGS. 11 and 14). The lid 27 is of a plane configuration and has in the illustrated embodiment approximately a square contour. It is centrally provided with a mounting opening 28 for the fan insert 16. The mounting plate 19 of the fan insert 16 is attached to the edge of the mounting opening 28 in a way known in the art.

In the folded state, the sidewalls 4 to 7 rests against the housing lid 27; the sidewalls 4 to 7 are pivotably connected to the edges 23, 24, 25, 26 of the lid 27, respectively.

Figure 13:
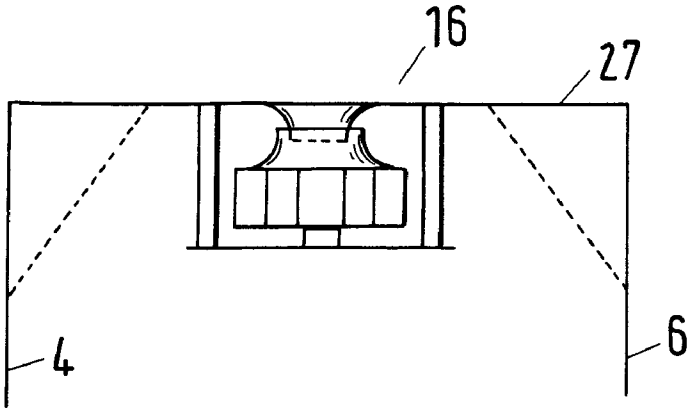
FIG. 13 shows the unfolded housing with fan insert.
Figure 16:
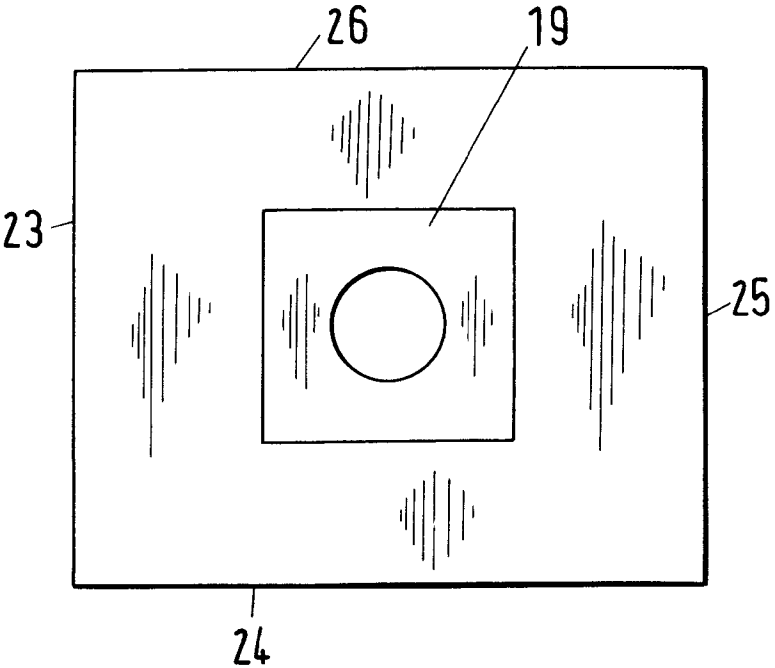
FIG. 16 is a plan view onto the filter-fan unit according to FIG. 15.
Figure 15:
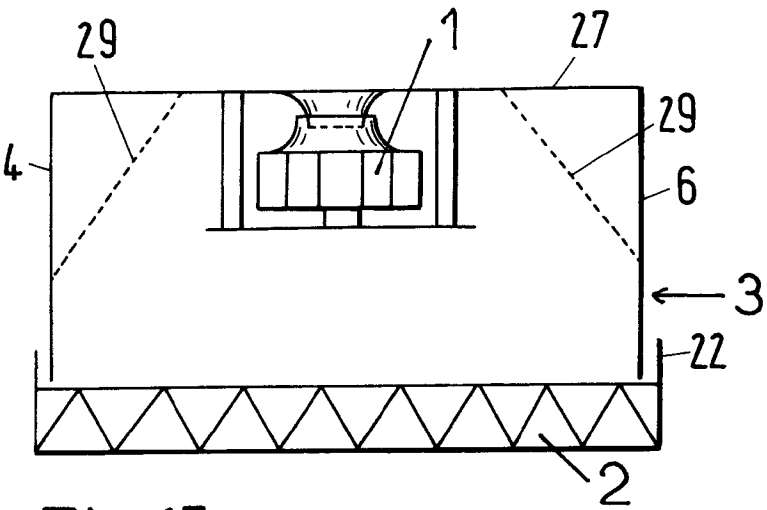
FIG. 15 is a side view of the finish-mounted filter-fan unit with attached suspended particle filter.
Figure 19:
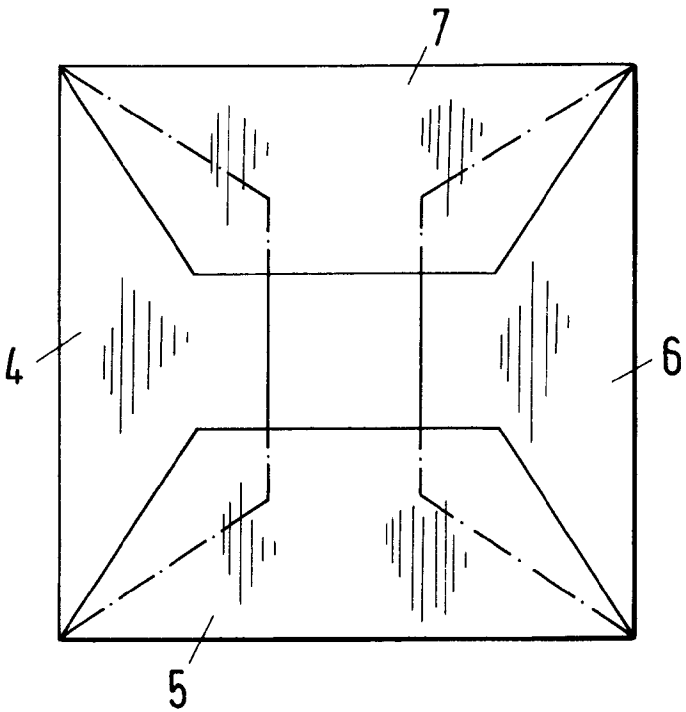
FIG. 19 is a plan view onto the folded housing according to FIG. 18.

FIG. 13 shows the situation when the sidewalls 4 to 7 are folded down. The bottom edges of the sidewalls 4 to 7 are connected to the projecting edge of the filter frame 22. As shown in FIG. 15, the upwardly projecting edge of the filter frame 22 extends past the bottom edges of the sidewalls 4 to 7. It is also possible that the bottom edges of the sidewalls 4 to 7 are positioned outwardly relative to the upwardly projecting edge of the filter frame 22. The filter frame 22 and the sidewalls 4 to 7 can be connected to one another in a suitable way so as to be airtight.

Advantageously, in the area between the sidewalls 4 to 7 and the lid 27 a micro-porous film 29 is provided as a soundproofing element. Upon folding out the housing 3, the film 29 is moved into a stretched position as illustrated in FIG. 15.

Figure 17:
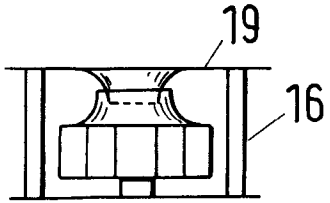
FIG. 17 is a side view of a fan insert of a further embodiment of a filter-fan unit according to the invention.
Figure 18:
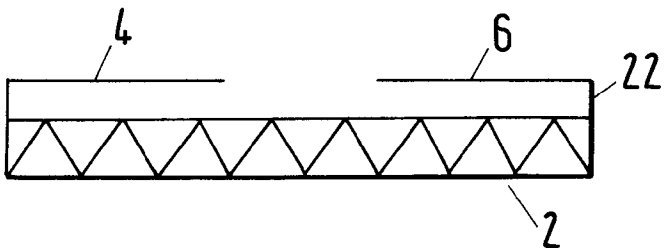
FIG. 18 is a schematic side view illustration of a further embodiment of the filter-fan unit according to the invention showing a folded housing that is provided on a suspended particle filter.
Figure 21:
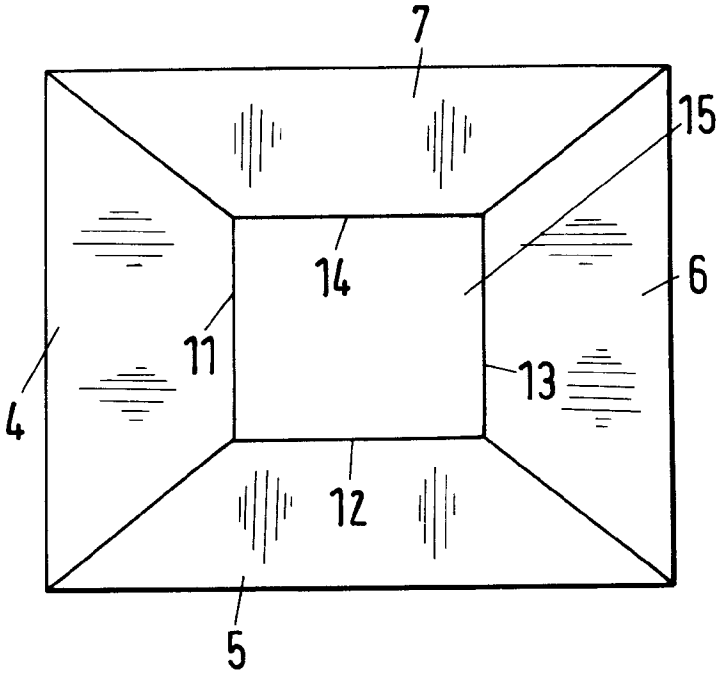
FIG. 21 shows a plan view onto the unfolded housing according to FIG. 20.
Figure 20:
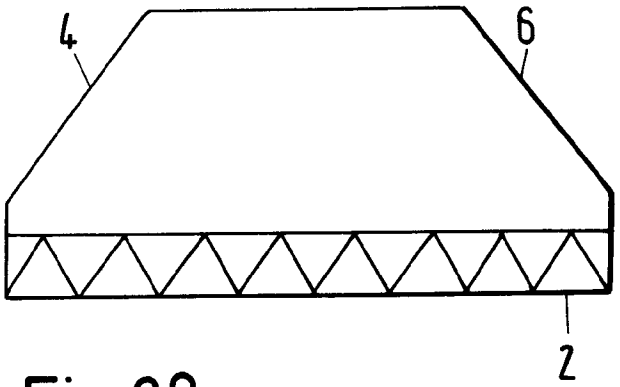
FIG. 20 shows the unfolded housing of FIG. 18.
Figure 23:
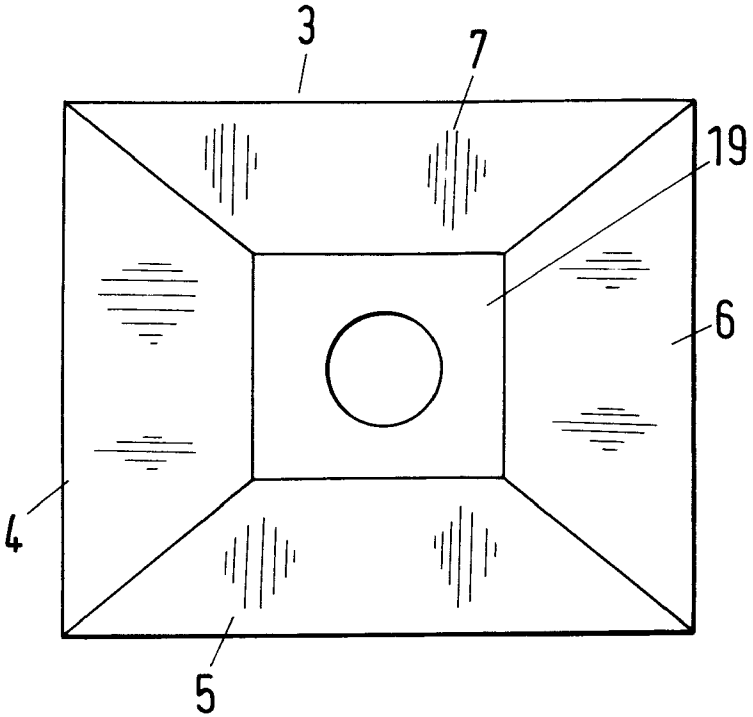
FIG. 23 shows the filter-fan unit according to FIG. 22 in a plan view.
Figure 22:
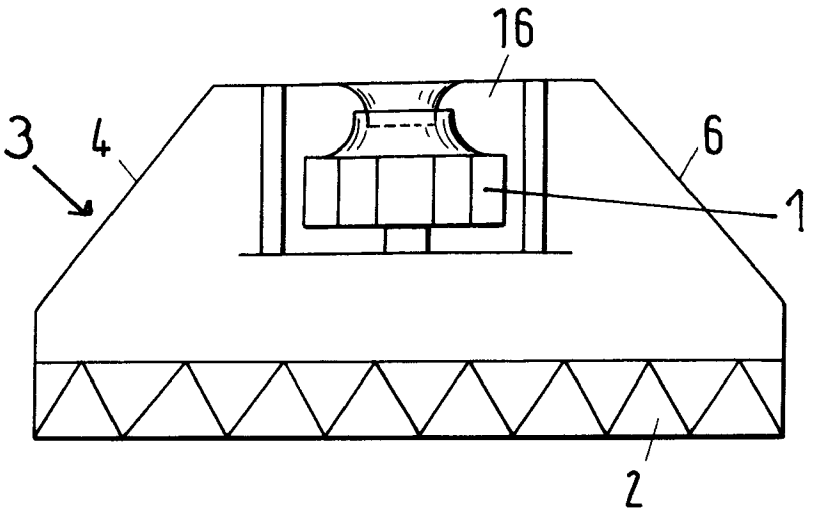
FIG. 22 is a schematic side view illustration of another embodiment of the filter-fan unit according to the invention showing an unfolded housing that is provided on a suspended particle filter
Figure 26:
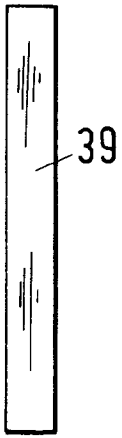
FIG. 26 is an end view of the folded housing according to FIG. 24.

The filter-fan unit according to FIG. 17 to 23 is similar to the embodiment according to FIGS. 1 through 9. The difference is that the sidewalls 4 to 7 are connected to the projecting edge of the filter frame 22. The folded housing 3 and the suspended particle filter 2 thus form a module. The sidewalls 4 to 7 are folded onto the suspended particle filter 2 (FIG. 18) so that this module comprised of housing 3 and suspended particle filter 2 requires only minimal space during transport. For completing the filter-fan units, the sidewalls 4 to 7 are folded upwardly and are connected fixedly to one another at their edges. The free edges 11 to 14 of the trapezoidal sidewalls 4 to 7 define the mounting opening 15 (FIG. 21) for the fan insert 16 (FIG. 17). The fan insert 16 is connected with its mounting plate 19 in the way described in connection with FIGS. 1 through 9 to the unfolded housing 3. In this embodiment, the suspended particle filter 2 must not be mounted separately so that the installation of the filter-fan unit is possible in a simple and quick way. Since the sidewalls 4 to 7 of the housing 3 are folded onto the suspended particle filter 2, the module of suspended particle filter 2 and folded housing 3 requires only minimal space.

Figure 28:
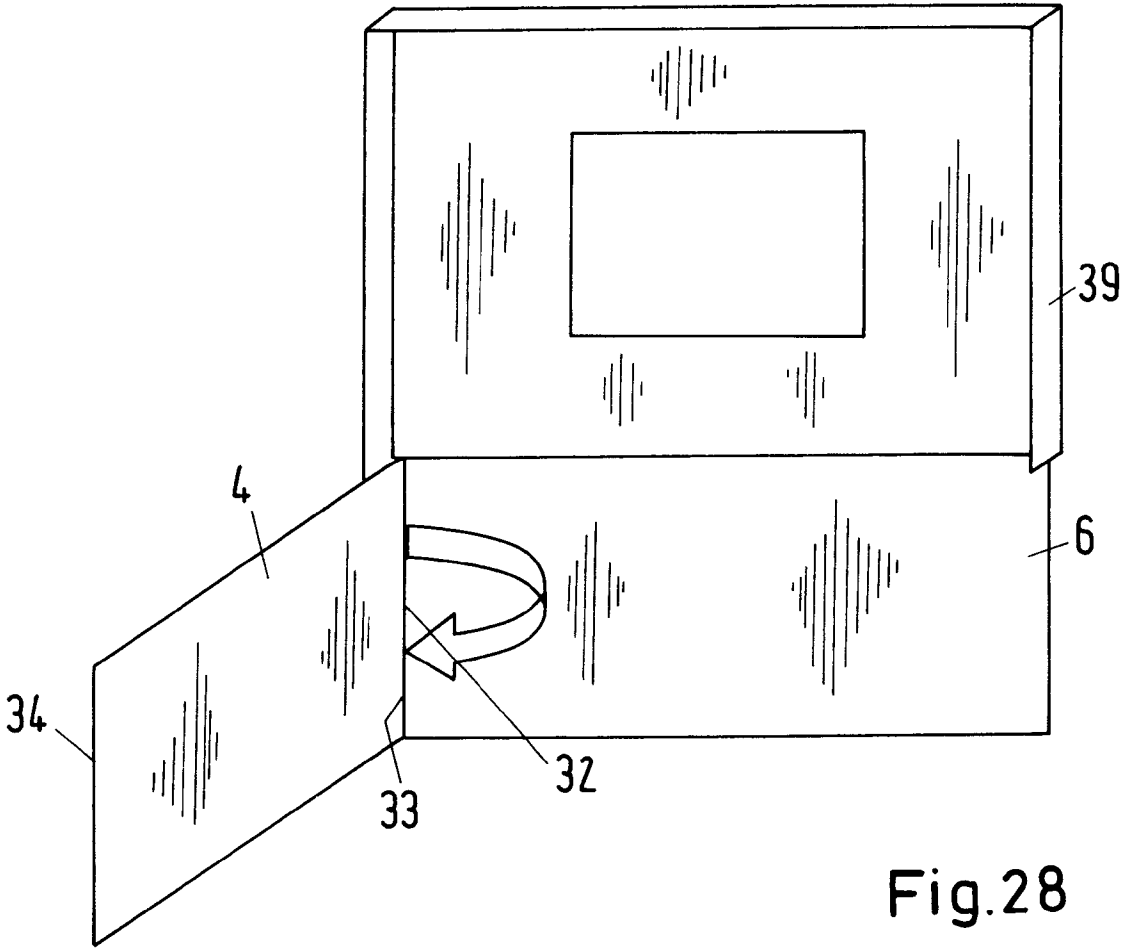
FIG. 28 shows the housing according to FIG. 24 in which the folded-down sidewalls are unfolded.
Figure 29:
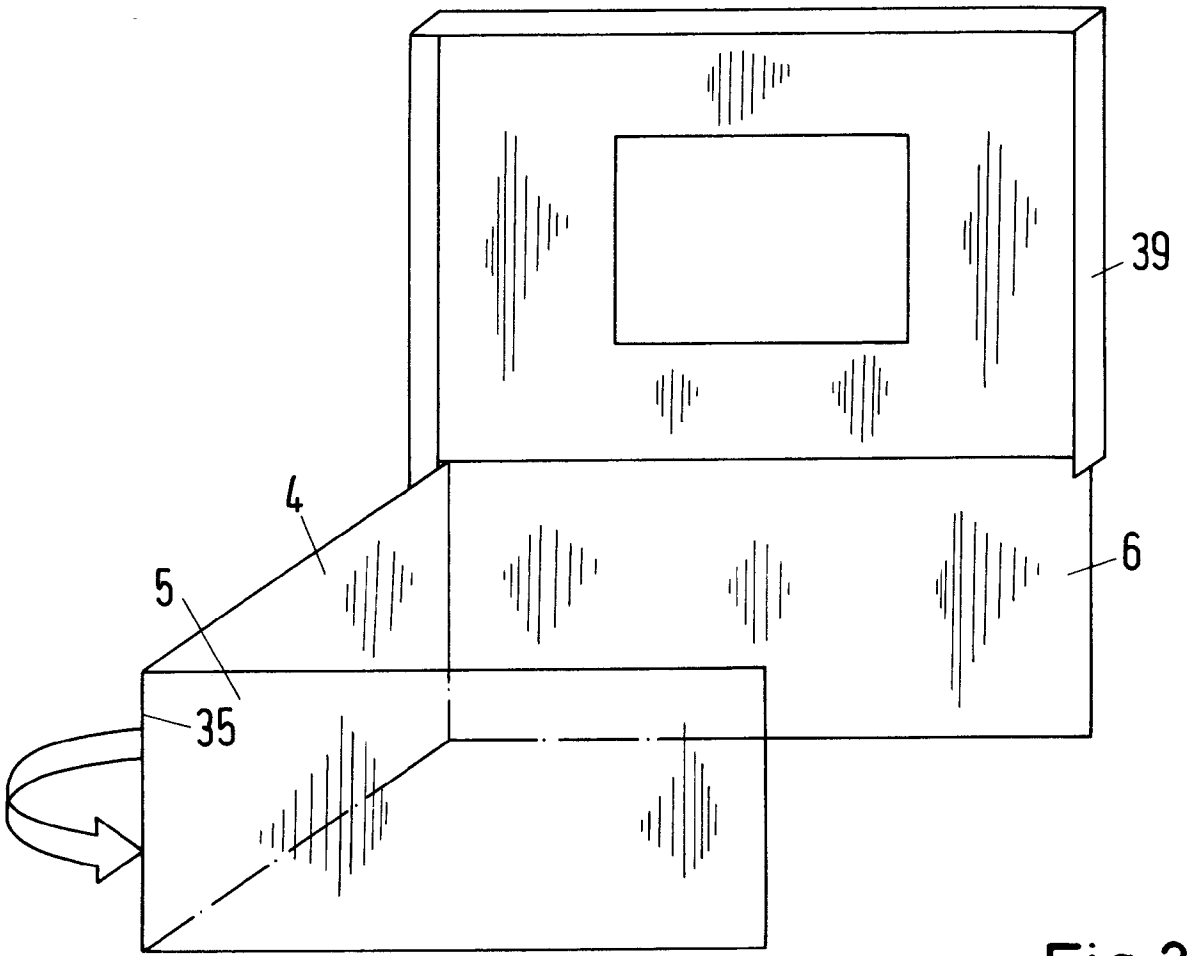
FIG. 29 is a representation in accordance with FIG. 28 showing a further step of unfolding the sidewalls of the housing.
Figure 30:
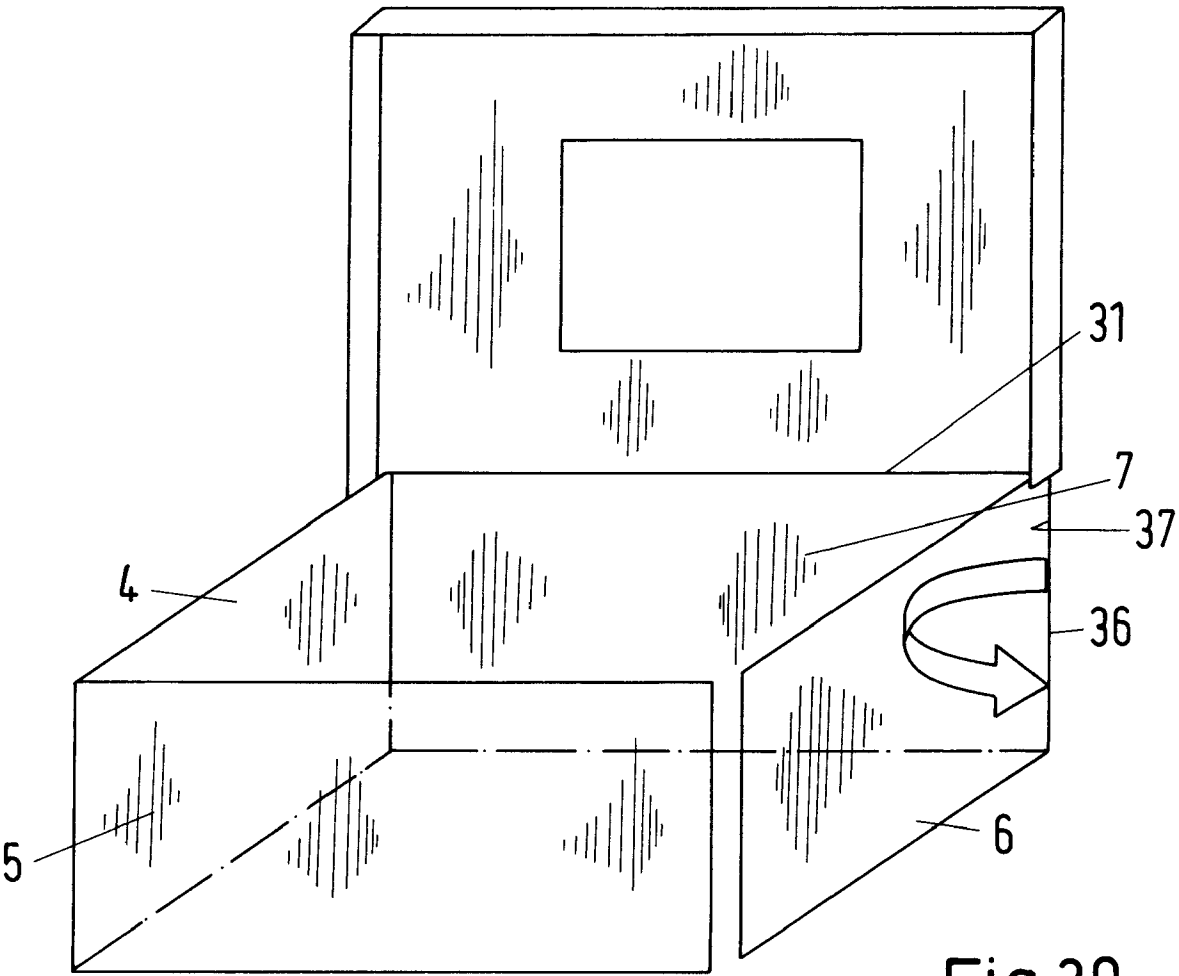
FIG. 30 shows the completely unfolded sidewalls of the housing.
Figure 31:
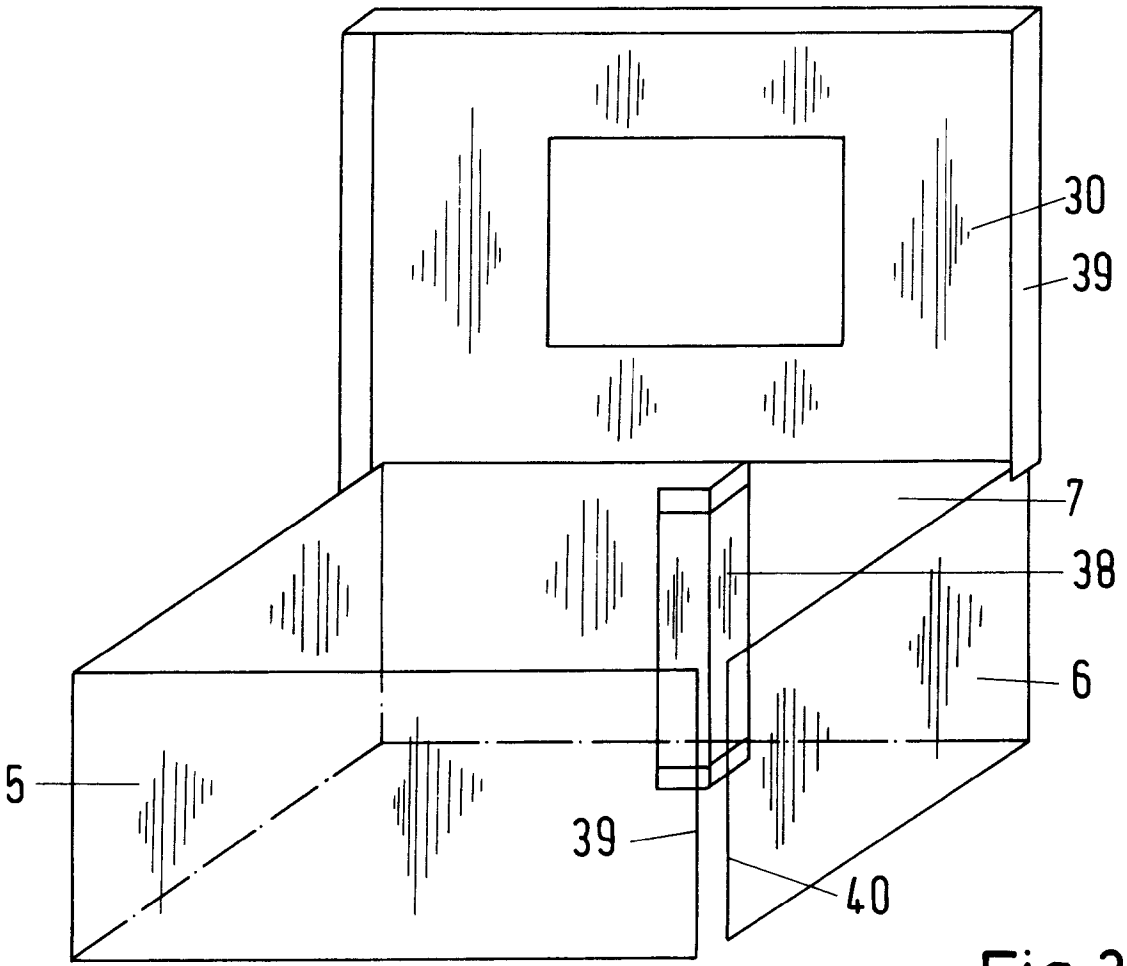
FIG. 31 shows the insertion of a connector for connecting the unfolded sidewalls of the housing.

With the aid of FIGS. 24 to 32 a housing 3 is described whose sidewalls 4 to 7 have a rectangular cross-section (FIG. 30). The housing 3 has a lid 30 that has a rectangular contour. At the longitudinal bottom edge of the lid 31 illustrated in FIG. 24 the sidewalls 4 to 7 are pivotably connected and, in turn, are pivotably connected to one another and are placed on top one another. The height of the sidewalls 4 to 7 is smaller than the width of the lid 30.

Figure 24:
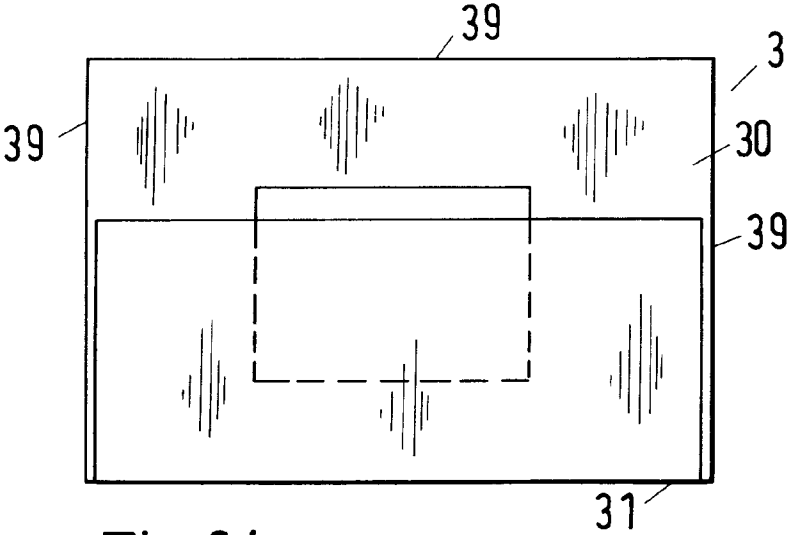
FIG. 24 is a plan view onto a further embodiment of a folded housing of a filter-fan unit according to the invention.
Figure 25:
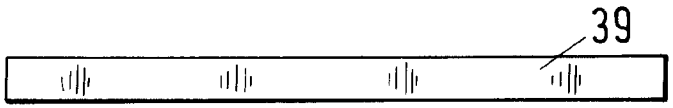
FIG. 25 is a side view of the folded housing according to FIG. 24.
Figure 27:
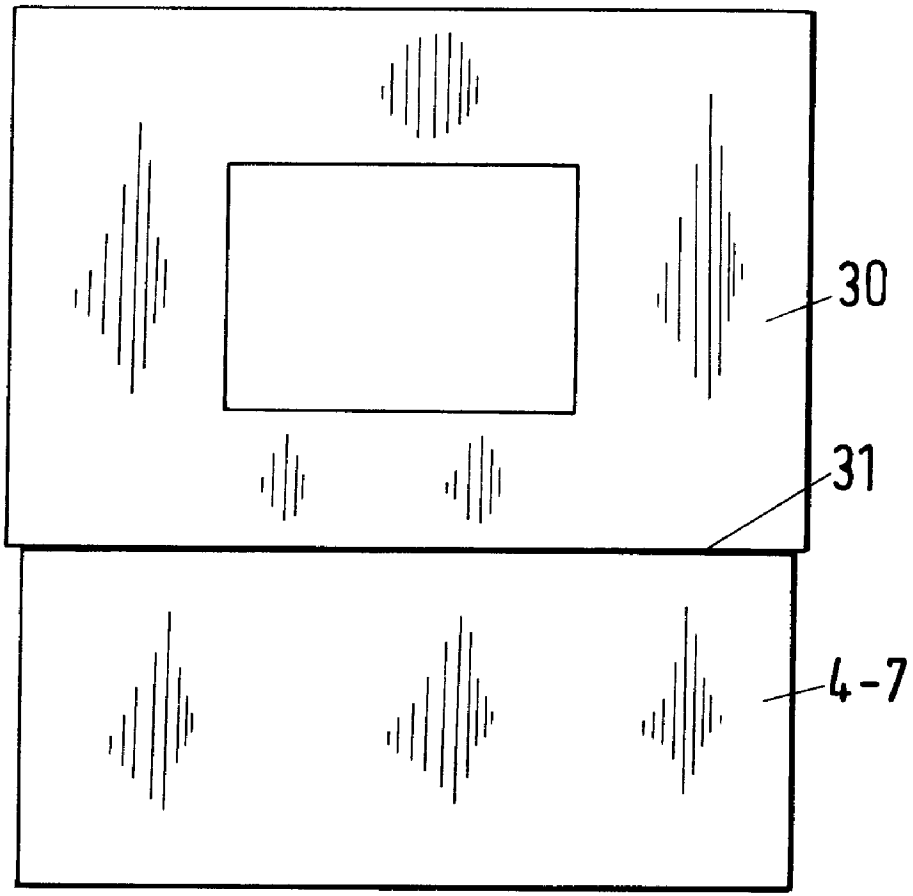
FIG. 27 shows the folded housing according to FIG. 24 in which the folded sidewalls are folded down.
Figure 38:
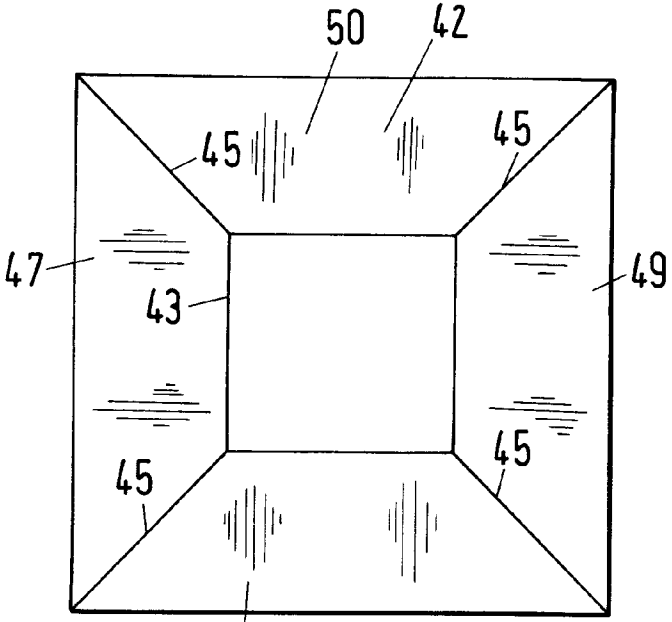
FIG. 38 is a plan view onto the housing according to FIG. 36.

In order to build the housing 3, the folded sidewalls 4 to 7 are first folded about the longitudinal edge 31 of the lid 30 (compare FIG. 24 and FIG. 27). Subsequently, the sidewalls 4 and 5 resting against one another are folded outwardly (FIG. 28). The sidewall 4 is connected with one narrow side 32 to the narrow side 33 of the sidewalls 7 that is hidden from view in FIG. 28. To the other narrow side 34 of the sidewall 4, the narrow side 35 of the sidewall 5 is connected in a pivotable way (compare FIG. 28 and FIG. 29). This sidewall 5, as illustrated in FIG. 29, is then folded about the lateral edges 34, 35. The sidewall 6 is connected with its narrow side 36 to the narrow side 37 of the sidewall 7 in a pivotable way. The sidewall 6 is unfolded finally about pivot axis 36, 37 (FIG. 30). By means of a connecting member 38 (FIG. 38) that is embodied as an angle member, the neighboring narrow sides 39, 40 of the sidewalls 5, 6 are tightly connected to one another.

Figure 32:
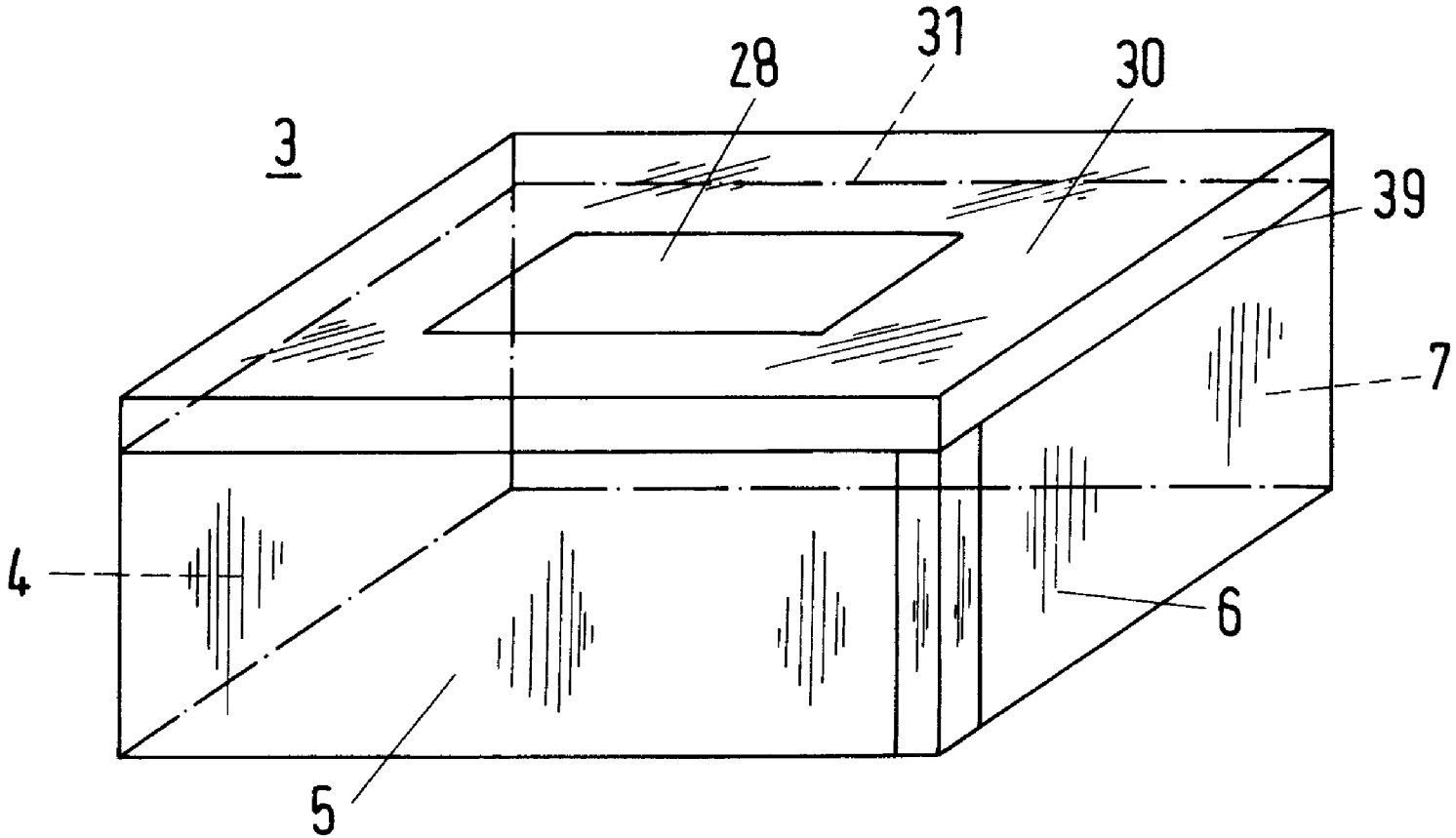
FIG. 32 shows the housing according to FIG. 31 with the lid in the closed position.

The lid 30 has a prependicularly projecting rim 30*a* which extends along three sides of the lid 30. Only at the longitudinal side 31 where the sidewall 7 is pivotably attached the rim 30*a* is not provided. When the housing 3 is in the folded state, the sidewalls 4 to 7 that are folded onto one another are located within the rim 30*a*. The rim 30*a* is advantageously only so tall that the folded sidewalls 4 to 7 do not project or project only slightly past the rim 30*a*. It is advantageous that the rim 30*a* has approximately the same height as the thickness of the folded sidewalls 4 through 7. When the lid 30 is closed (FIG. 32) the rim 30*a* projects past the upper longitudinal edge of the sidewalls 4 to 6. As shown in FIG. 32, the longitudinal edge 31 serving as the pivot axis is positioned at the level of the free edge of the lid rim 30*a*. In the lid 30 there is centrally a mounting opening 28 that has a rectangular contour in the illustrated embodiment but, depending on the configuration of the fan insert 16, can also have different contour shapes. The fan insert 16 is mounted in the mounting opening 28 of the housing 3 according to FIG. 32. Subsequently, the housing 3 that is open in the downward direction is placed onto the suspended particle filter 2 and is fixedly connected thereto. The suspended particle filter 2 closes off the bottom side of the housing 3.

Figure 35:
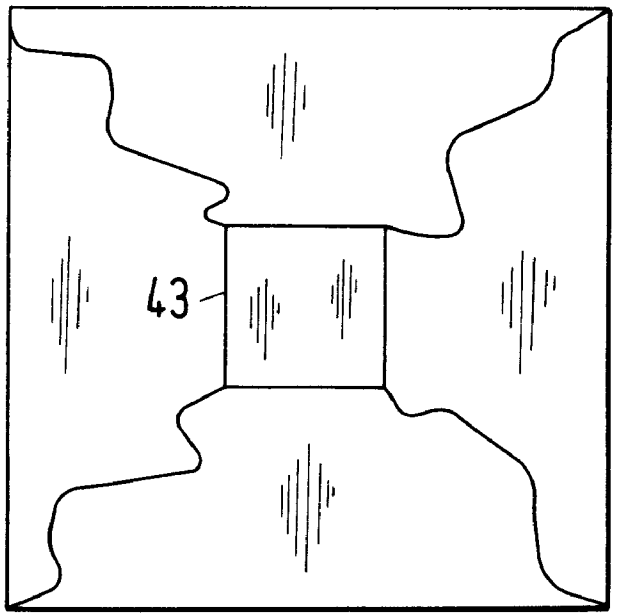
FIG. 35 is a plan view onto the housing according to FIG. 33.
Figure 33:
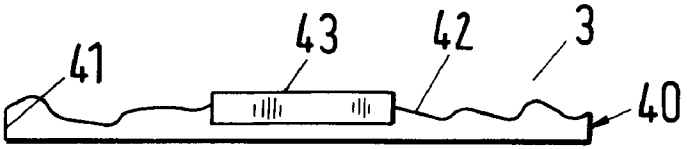
FIG. 33 is a schematic side view illustration of the folded state of the housing of another embodiment of the filter-fan unit according to the invention.
Figure 34:
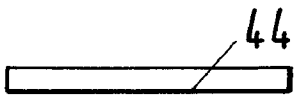
FIG. 34 shows a reinforcement element of the housing according to FIG. 33.

The housing according to FIGS. 33 to 35 has a shape-stable housing frame 41 with an angled circumferential rim 41*a*. The housing 3 is attached to the rim 41*a*. The housing is comprised of a fabric 42 that is flame resistant. As a reinforcement, centrally within the fabric a rectangular reinforcement frame 43 is attached into which the fan insert 16 is inserted.

Figure 36:
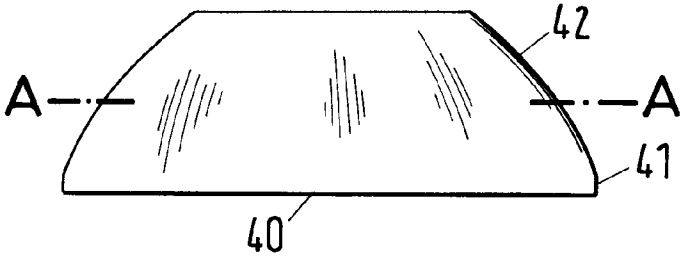
FIG. 36 shows the unfolded housing according to FIG. 33 in a side view.
Figure 37:
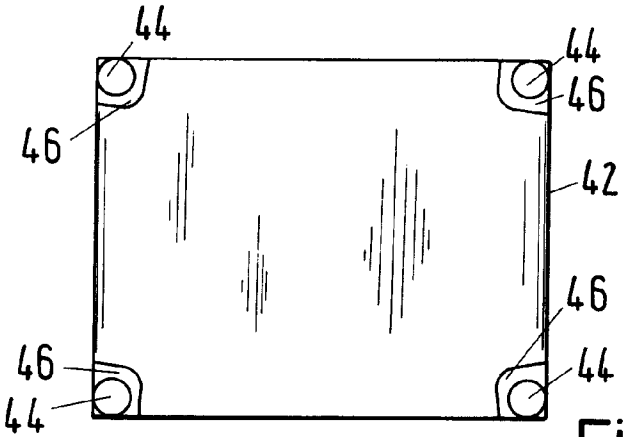
FIG. 37 shows a section along the section line XXXVII-XXXII of FIG. 36.

In order for the housing 3 that is made from fabric to keep its shape, profiled sections 44 are provided as reinforcement. They are arranged in the corner areas of the housing frame 41 in such a way that the fabric will keep taut the unfolded housing 3. On the inner side of the fabric 42 along the seams 45 (FIG. 38) receptacles 46 for the reinforcing profiled sections 44 are provided. The receptacles 46 can extend across the entire length of the seams 45 but can also be arranged along the seams at a spacing from one another. The reinforcing profiled sections 44 are, for example, round elastically bendable rods that are supported with their first end in receptacles (not illustrated) in the corner area of the housing frame 41 and with their second end in receptacles in the corner area of the reinforcement frame 43. The fabric 42 is tailored such that the rods 44 are bent about their length when they are positioned with their ends in the receptacles of the two frames 41, 43. The fabric 42, as shown in FIG. 36, is curved outwardly and is kept in a stretched position.

The fabric 42 forming the housing is comprised advantageously of four trapezoidal tailored sections 47 to 50 which are connected to one another at their abutting edges by seams 45. The seams 45 can be formed also by a zipper or by a hook-and-loop fastener.

FIGS. 39 to 42 finally show possible configurations of the pivot connections as they are provided in all disclosed embodiments.

Figure 39:
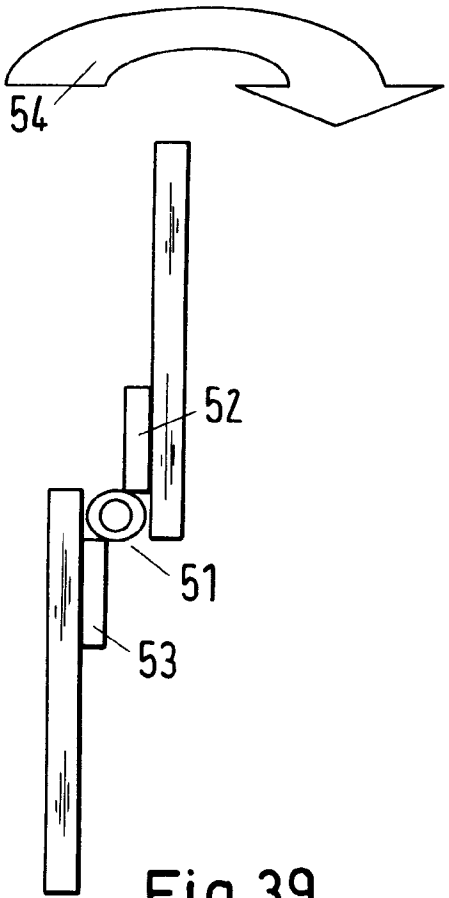
FIG. 39 show a first pivot connection between neighboring housing sidewalls.

FIG. 39 shows that the parts to be pivotably connected to one another are connected by a hinge 51 in a pivotable way. As is known in the art, the hinge fittings 52, 53 are attached to the parts that are pivotable relative to one another. The pivot direction is indicated by arrow 54.

Figure 40:
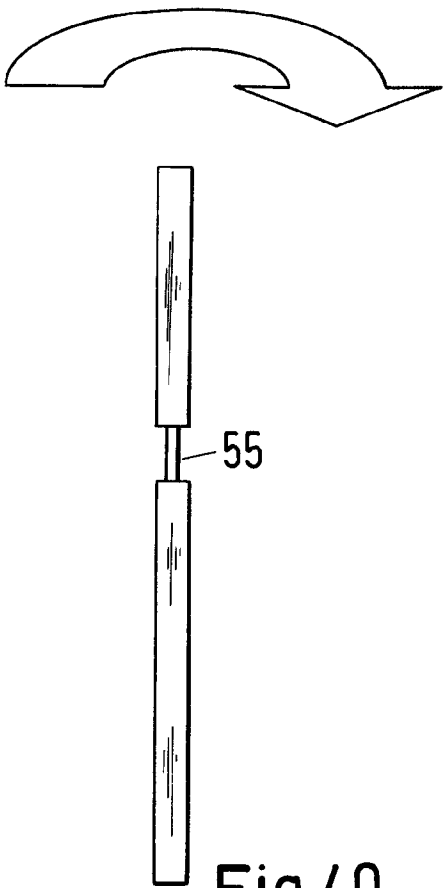
FIG. 40 shows a second pivot connection between neighboring housing sidewalls.

FIG. 40 shows the possibility of providing the pivot connection 55 by a portion of reduced or weakened material between the parts to be pivoted relative to one another. This portion of reduced material thickness forms a predetermined bending location.

Figure 41:
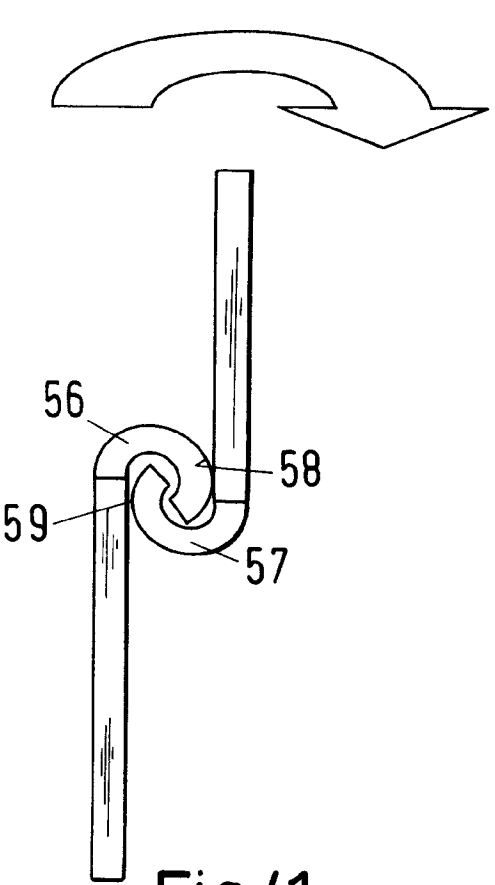
FIG. 41 shows a third pivot connection between neighboring housing sidewalls.

FIG. 41 shows the possibility of providing on the parts to be pivotable relative to one another shaped pivot elements 56, 57 that are curved approximately like a part of a circle and that engage one another. The shaped pivot elements 56, 57 are attached to the end faces of the corresponding parts that are pivotable relative to one another and can extend about the entire length of these end faces. It is also possible to provide individual pivot elements across the length of the end faces. The pivot elements 56, 57 engage one another in such a way that in the pivot direction they cannot be detached from one another. The two parts that are pivotably connected to one another can be detached from one another only by sliding in the direction of the pivot axis. As is shown in FIG. 41, the pivot elements 56, 57 are curved in such a way that their free ends engage or mesh with one another and their curved areas 58, 59 rest against the respective neighboring part to be pivoted when they are in the parallel position illustrated in FIG. 41.

Figure 42:
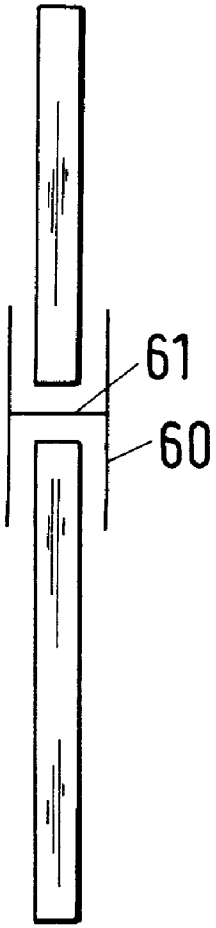
FIG. 42 shows a fourth pivot connection between neighboring housing sidewalls.

FIG. 42 finally shows the possibility of connecting the two parts pivotable relative to one another by a profiled section 60 that has the shape of an H. The two parts to be connected to one another project into the profiled section and are separated from one another by the transverse web 61 of the profiled section 60. The profiled section 60 extends also advantageously across the length of the corresponding edges of the parts to be connected.

In the described embodiments, the different parts can be connected to one another at their abutting locations in ways known in the art.

The specification incorporates by reference the entire is closure of German priority document 10 2005 062 523.1 having a filing date of 19 Dec. 2005.

While specific embodiments of the invention have been shown and described in detail to illustrate the inventive principles, it will be understood that the invention may be embodied otherwise without departing from such principles.

What is claimed is:

1. A filter-fan unit comprising:

a frame structure;

a housing comprising sidewalls each connected with one side by a pivot connection to the frame structure;

at least one fan arranged in the housing;

at least one filter connected to the housing;

wherein the housing has a transport/storage position in which the sidewalls are folded flat onto one another and a position of use, wherein the housing is transferred from the transport/storage position into the position of use in that the sidewalls are pivoted into a substantially upright position relative to the frame structure;

wherein the transport/storage position is significantly smaller than the position of uses;

wherein the sidewalls in the position of use have adjoining lateral edges that are connected to one another and the sidewalls form sidewalls of the filter-fan unit and define a housing interior of the housing in which housing interior the at least one fan is arranged.

2. The filter-fan unit according to claim 1, wherein the housing comprises a housing frame and the housing frame is the frame structure to which the sidewalls are pivotably connected.

3. The filter-fan unit according to claim 2, wherein the housing frame has an angled contour.

4. The filter-fan unit according to claim 2, wherein the sidewalls have a trapezoidal contour.

5. The filter-fan unit according to claim 4, wherein the housing is pyramid-shaped in the position of use.

6. The filter-fan unit according to claim 2, wherein the sidewalls rest atop one another in the transport/storage position.

7. The filter-fan unit according to claim 2, wherein the sidewalls each have a free edge and the free edges in the position of use delimit a mounting opening for the at least one fan.

8. The filter-fan unit according to claim 2, wherein the sidewalls each have a soundproofing layer arranged at a face of the sidewalls facing the housing interior in the position of use.

9. The filter-fan unit according to claim 2, wherein the at least one fan is a fan insert that is attached to the housing.

10. The filter-fan unit according to claim 9, wherein the housing has a lid that is connected to the fan insert.

11. The filter-fan unit according to claim 10, wherein the lid has circumferential edges and wherein the sidewalls are pivotably connected to the circumferential edges.

12. The filter-fan unit according to claim 11, wherein the sidewalls rest against the lid when the housing is in the transport/storage position.

13. The filter-fan unit according to claim 11, wherein the sidewalls of the housing overlap one another partially when the housing is in the transport/storage position.

14. The filter-fan unit according to claim 11, wherein the sidewalls of the housing have a rectangular contour.

15. The filter-fan unit according to claim 11, wherein the at least one filter has a filter frame, wherein the sidewalls each have a bottom edge and in the position of use the bottom edges are connected to the filter frame or placed into, onto or so as to surround the filter frame.

16. The filter-fan unit according to claim 10, wherein between the lid and the sidewalls a flexible micro-porous film is provided for sound absorption.

17. The filter-fan unit according to claim 2, wherein the housing is connected to a filter frame of the filter.

18. The filter-fan unit according to claim 17, wherein the filter frame is the frame structure to which the sidewalls are connected pivotably.

19. The filter-fan unit according to claim 18, wherein the sidewalls each have a trapezoidal shape.

20. The filter-fan unit according to claim 1, wherein the at least one filter has a filter frame that is placeable onto the housing, into the housing or so as to surround the housing.

21. The filter-fan unit according to claim 20, wherein the filter frame has a projecting part and the projecting part is the frame structure to which the sidewalls are pivotably connected.

22. The filter-fan unit according to claim 1, wherein the sidewalls are substantially identical in size.

23. The filter-fan unit according to claim 1, wherein the pivot connection is selected from the group consisting of a hinge, a predetermined bending location, a portion of reduced material thickness, and meshing shaped pivot elements.

24. A filter-fan unit comprising:

a housing comprising sidewalls;

at least one filter connected to the housing;

wherein the housing has a transport/storage position in which the sidewalls are folded flat onto one another and a position of use, wherein the housing is transferred from the transport/storage position into the position of use in that the sidewalls are unfolded into an unfolded state and form sidewalls of the filter-fan unit;

wherein the transport/storage position is significantly smaller than the position of use;

wherein the sidewalls are connected by a pivot connection to one another at adjoining parallel extending lateral edges so that the sidewalls when unfolded are arranged sequentially in a row and have free lateral edges at opposed ends of the row;

a lid connected by a pivot connection to one of the sidewalls at an edge that extends perpendicular to the parallel extending lateral edges;

wherein free lateral edges in the unfolded state are connected to one another and the sidewalls and the lid define a housing interior of the housing; and at least one fan arranged in the housing interior.

25. The filter-fan unit according to claim 24, wherein the lid has a quadrangular contour.

26. The filter-fan unit according to claim 24, wherein the free lateral edges are connected to one another with at least one connecting member.

27. The filter-fan unit according to claim 24, wherein the lid is provided on three sides with a projecting rim.

28. The filter-fan unit according to claim 27, wherein the projecting rim of the lid delimits a receiving space for the sidewalls.

29. The filter-fan unit according to claim 24, wherein the lid has at least one mounting opening for the at least one fan.

30. The filter-fan unit according to claim 24, wherein the pivot connection of the sidewalls and the lid is selected from the group consisting of a hinge, a predetermined bending location, a portion of reduced material thickness, and meshing shaped pivot elements.

31. A filter-fan unit comprising:

a housing comprising a shape-stable frame, a reinforcementframe, a housing wall comprised of foldable fabric, and reinforcing profiled sections, wherein the foldable fabric is attached to the shape-stable frame and connects the shape-stable frame and the reinforcement frame;

at least one filter connected to the housing;

wherein the housing has a transport/storage position in which the foldable fabric and the reinforcement frame lie on the shape-stable frame and a position of use in which the foldable fabric is tensioned upwardly by the reinforcing profiled sections and the reinforcement frame is spaced a part from the shape-stable frame by the reinforcing profiled sections;

wherein the transport/storage position is significantly smaller than the position of use;

wherein the foldable fabric in the position of use forms sidewalls of the filter-fan unit and defines a housing interior of the housing; and at least one fan arranged in the housing interior and connected to the reinforcement frame in the position of use.

32. The filter-fan unit according to claim 31, wherein the foldable fabric is comprised of tailored sections.

33. The filter-fan unit according to claim 32, wherein the tailored sections are identical.

34. The filter-fan unit according to claim 31, wherein the reinforcing profiled sections each have opposed ends that are supported with pretension on the housing frame and the reinforcement frame.

35. The filter-fan unit according to claim 34, wherein the fabric is comprised of tailored sections and wherein the reinforcing profiled sections are arranged in an area where the tailored sections are connected to one another.

36. The filter-fan unit according to claim 31, wherein the fabric is flame resistant.

* * * * *